United States Patent [19]

Friend et al.

[11] 4,141,299

[45] Feb. 27, 1979

[54] DUMPING RAILWAY QUENCH CAR

[75] Inventors: Donald L. Friend, McCandless Township, Allegheny County; John A. Grosko, West Mifflin Borough; Ernest S. Lanyi, Elizabeth Borough, all of Pa.

[73] Assignee: United States Steel Corporation, Pittsburgh, Pa.

[21] Appl. No.: 802,837

[22] Filed: Jun. 2, 1977

[51] Int. Cl.[2] ..... B61D 3/04; B61D 3/16; B61D 7/10; B61D 9/02

[52] U.S. Cl. ..... 105/260; 105/263; 105/273

[58] Field of Search ..... 105/254, 260, 263, 273; 214/82, 14 PH

[56] References Cited

U.S. PATENT DOCUMENTS

| | | | |
|---|---|---|---|
| 1,140,563 | 5/1915 | Barth | 105/260 |
| 1,812,539 | 6/1931 | Ludowici | 105/260 |
| 4,010,695 | 3/1977 | Mantione | 105/254 |
| 4,096,041 | 3/1977 | Friend | 214/18 PH X |

FOREIGN PATENT DOCUMENTS

| | | | |
|---|---|---|---|
| 145699 | 5/1921 | United Kingdom | 105/260 |

*Primary Examiner*—Frank E. Werner
*Assistant Examiner*—Howard Beltran
*Attorney, Agent, or Firm*—William F. Riesmeyer, III

[57] ABSTRACT

A single-spot quench car is disclosed which has an articulating bottom and back wall arrangement. The articulation of the bottom and back walls serve to increase the volume of the car and to facilitate dumping of coke from the car after quenching.

2 Claims, 4 Drawing Figures

DUMPING RAILWAY QUENCH CAR

BACKGROUND OF THE INVENTION

1. Field of the Invention

This invention relates to a quench car for receiving coke from a coke oven and transporting it to a quench tower. In particular, this invention relates to an improved quench car of the single-spot type.

2. Description of the Prior Art

In the past, quench cars were constructed to be shallow and long. It was thought that the thinner the bed of coke in the car, the easier the job of uniformly quenching the coke while in the car. The shallow and long quench cars are the travelling-type and are filled as they move past the coke oven. Although uniform quenching may be accomplished through the use of the travelling-type quench car, significant problems have arisen in attempts to control pollution emissions when pushing the coke from the oven into the car. The movement of the car when receiving coke complicates the utilization of shrouds, hoods, and covers. The application of a hood and an exhaust system to a quench car to control pollution emissions would be facilitated by eliminating the movement of the car past the oven during a push.

The quench car which remains stationary in front of a coke oven while receiving a push of coke is known as a single-spot quench car. Because it is stationary, rigging a hood and exhaust system to cover the car and positioning the car to receive the coke is made easier. However, the single-spot quench cars currently in use are inadequate. The coke ovens in operation today establish well-defined parameters within which a single-spot quench car must be designed; parameters which are well suited to a long, shallow quench car (i.e., the travelling-type). Other confining parameters are the traditional floor slope for effective coke dumping and the angle of declination of the coke as it is received in the car. A single-spot quench car designed within these parameters has a correspondingly small transverse cross-sectional area. This limits the volume of the car to such an extent that an entire push of coke cannot be completely received in the car. One type of single-spot quench car found today uses a non-sloping floor to try to increase the car's volume. Without a sloping floor the car cannot be dumped merely by raising a gate at the front of the car. The entire coke container must be rotated to dump the coke. Nearby equipment, such as the coke guide, severely limits the available space for rotating the container.

SUMMARY OF THE INVENTION

According to the present invention, the bottom and back walls of a single-spot quench car are joined in an articulating fashion. Motor means moves the bottom and back wall relative to the front and side walls and the frame to dump the coke. When the part of the bottom wall along the front wall moves downwardly away from the front wall an opening is formed through which the coke is dumped.

It is an object to this invention to significantly increase the volume of a single-spot coke quench car.

It is a further object of this invention to overcome the space limitation associated with rotating the entire coke container for dumping.

It is a still further object of this invention to present an arrangement for retrofitting existing coke batteries with a coke quench car which may be easily equipped with pollution emission control equipment.

DESCRIPTION OF THE PREFERRED EMBODIMENT

Figure 2:
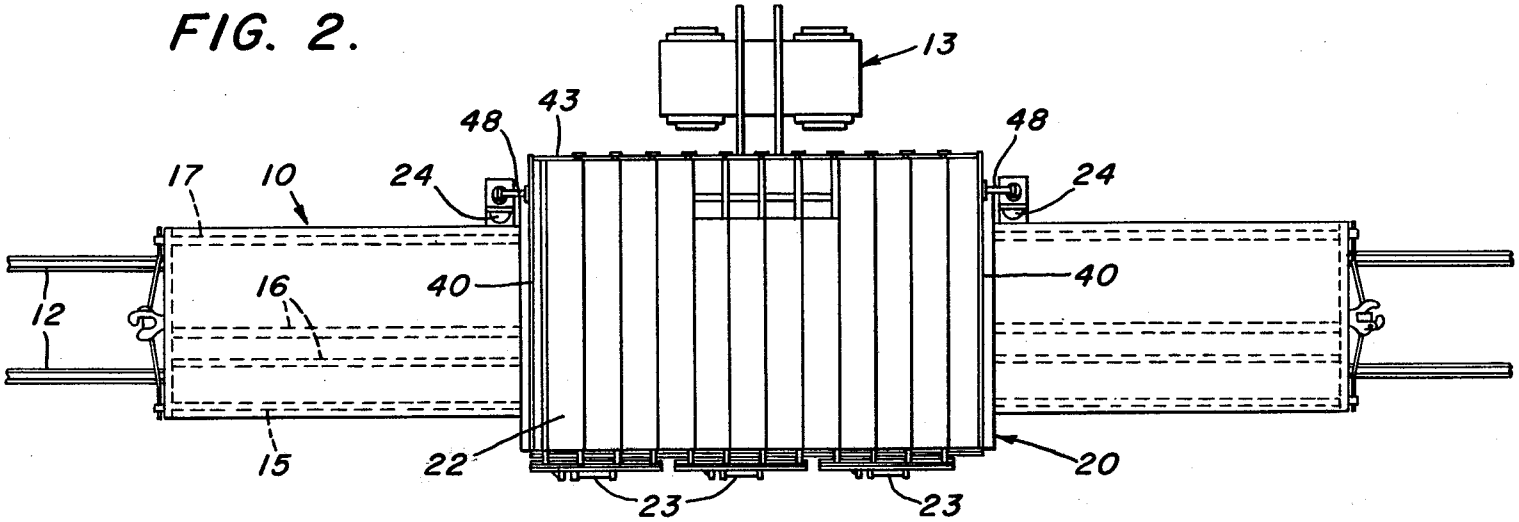
FIG. 2 is a plan view of the quench car of FIG. 1.
Figure 1:
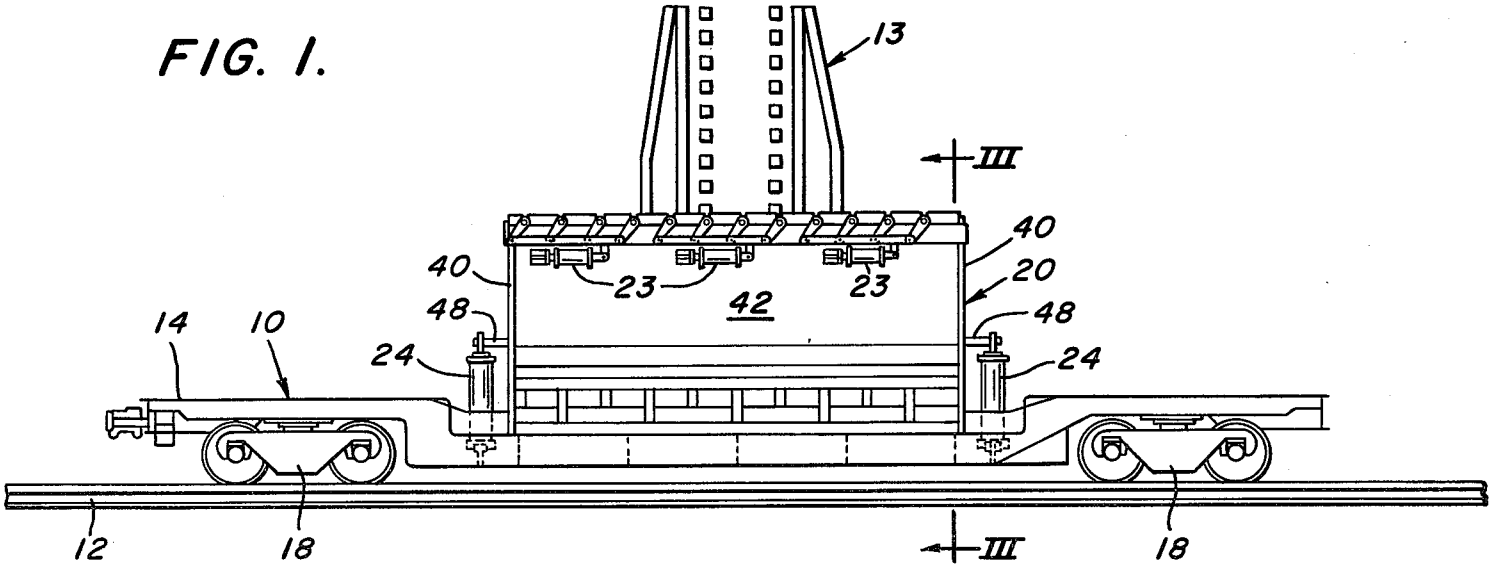
FIG. 1 is a side elevation view of the quench car made in accordance with this invention.

With reference to FIGS. 1 and 2, a quench car 10 made in accordance with this invention is shown on rails 12 alongside a coke guide 13. The quench car 10 has a frame 14 which includes front, center, and rear horizontal members 15, 16 and 17, respectively. Rotatably mounted by conventional means to the underside of frame 14 are rail trucks 18 for supporting the quench car 10 for movement along the rails 12. On the topside of frame 14 is mounted a coke container 20. The coke container 20 has a slatted top closure 22 and operating means therefore 23 as disclosed in a co-pending U.S. patent application Ser. No. 776,402, filed Mar. 10, 1977, now U.S. Pat. No. 4,096,041, issued June 20, 1978 of common ownership. Cylinders 24 mounted between the coke container 20 and the frame 14 are part of the actuating means for the articulating dump feature of this invention.

Coke container 20 comprises substantially parallel and generally upstanding end walls 40 rigidly attached to the frame 14. Front wall 42, slightly shorter in height than the end walls 40, is attached rigidly at each end to the front of the end walls and is generally upstanding. To help relieve any compressive force between the walls when dumping coke from the car, it may be desirable to rearwardly incline front wall 42. Additionally, front wall 42 may be pivotally mounted near its upper end rather than rigidly attached to end walls 40. If front wall 42 is pivotally mounted it can be made to swing freely away from the end walls or restrained at its bottom with springs or the like. A back plate 43 joins the back of the end walls 40.

Figure 3:
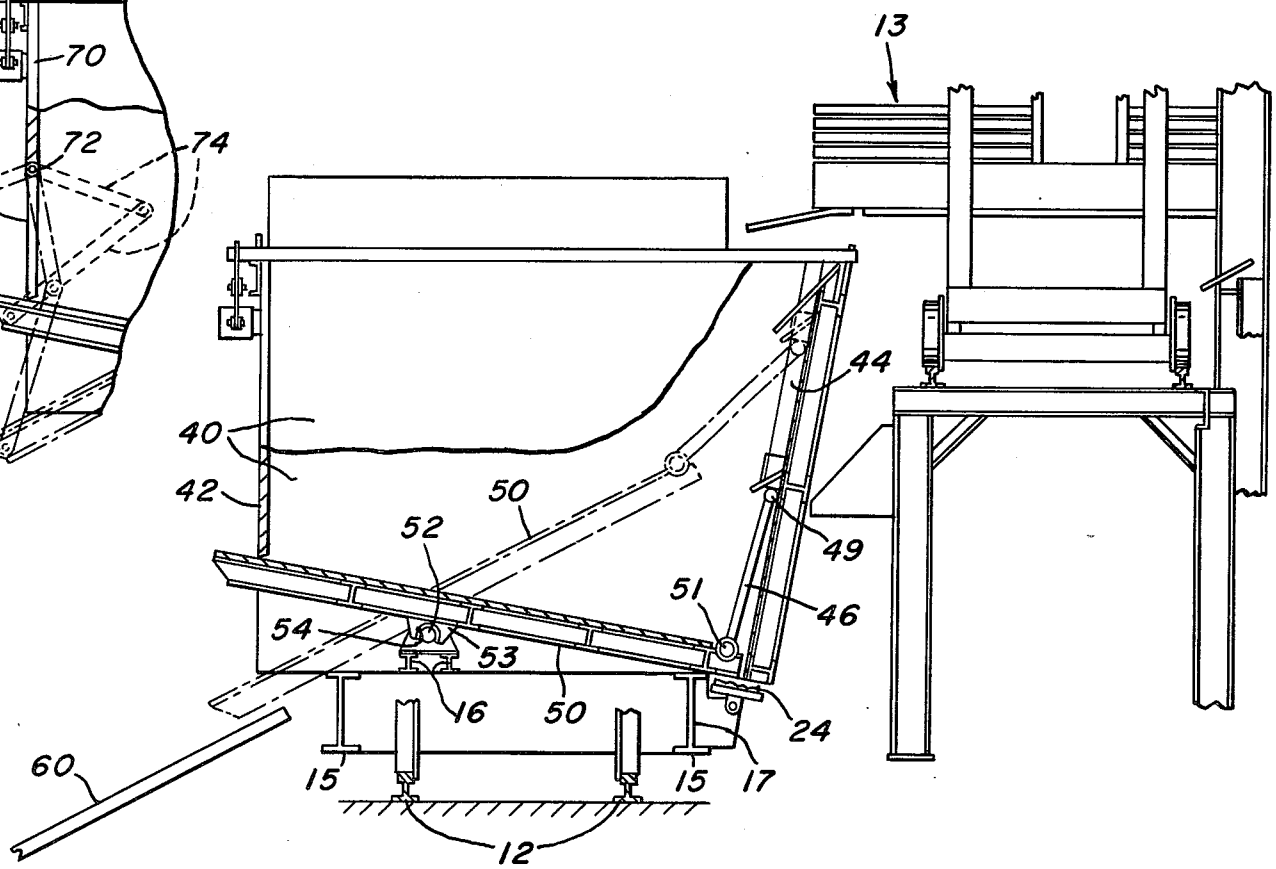
FIG. 3 is a view taken along the line III—III of FIG. 1.

As best seen in FIG. 3, the end walls 40 have slots 44 which are slightly reclined. These slots extend from the top to about the middle of the rear portion of the end walls. Seen also in FIG. 3 is a movable back wall 46. It is shown in its position for receiving coke from the coke oven. Its position for dumping coke is shown in phantom lines. The edges of the back wall 46 are in sliding contact with end walls 40 and back plate 43. The walls need not actually be close enough to wear but only close enough to prevent pieces of coke from escaping the container between the edges of the back wall and the sides of the end walls. Attached to the upper corners of the back walls 46 are bars 48 which extend beyond the end walls 40 and support the back wall in the slots. Other structural shapes may be substituted for the bars provided they are suitable for sliding along the length of the slots. It is preferred that the bars 48 are the ends of a single bar member 49 attached to and extending across the upper edge of the back wall 46 and beyond the end walls 40. A pipe would be a suitable substitute for the bar 49. Cylinders 24 are connected to the ends 48 of bar 49 and to rear horizontal member 17 of frame 14 for moving back wall 46.

In FIGS. 1 and 3, the bottom wall 50 of the coke container 20 is shown in its coke receiving position. It is attached along its rear edge to the bottom edge of movable back wall 46. The attachment of the bottom and back walls is through a hinged joint 51. The front end of the bottom wall 50 is slightly higher than the rear end forming an angle of approximately 10°–15° from the horizontal. The bottom wall is pivotally mounted to center horizontal frame member 16 and, like the back wall 46, its edges are in sliding contact with end walls 40. A bar or pipe 52 is attached along the length of the frame member 16 in a substantially parallel manner. Saddles 53 having inverted U-shaped openings 54 are mounted to the underside of the bottom wall 50 on a line slightly forward of center. The bar 52 engages the saddles 53 to provide the pivotal mounting of the bottom wall to the frame. In this coke receiving or reclined position of the bottom wall, its front portion rests against the bottom edge of front wall 42. Its rear rests against rear horizontal frame member 17. The inclined position of the bottom wall 50 shown in phantom is the coke dumping position. In the inclined position, the bottom wall is on an angle of about 28°–32° with the horizontal and its front position rests against front horizontal frame member 15. The opening thus created between the bottom of front wall 42 and the bottom wall provides the exit for the coke from the container.

Also seen in FIG. 3 is the coke wharf 60 and the coke guide 13. In the operation of this invention, coke is pushed from the coke oven through the coke guide into the quench car 10. The bottom and back walls of the cars are in their coke receiving positions. The coke is then transported in the car to the quenching station where quench water is introduced in the car. Then the car is moved to the coke wharf. At the wharf cylinders 24 are energized and begin to move the back wall 46 upwardly with bars 48 moving in slots 44. The movement of back wall 46 causes the bottom wall 50 to pivot from its reclined position to its inclined position (shown in phantom in FIG. 3). The coke, then, is able to fall by gravity from the car through the opening between the front wall and the bottom wall and onto the wharf 60.

Figure 4:
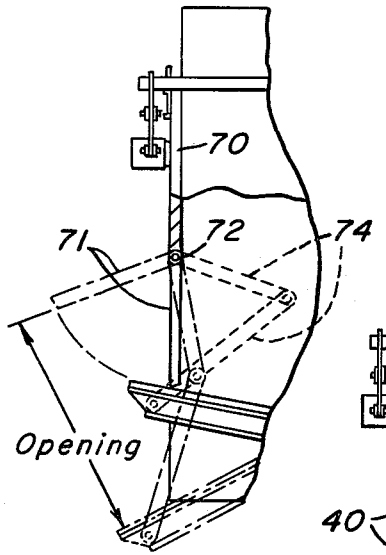
FIG. 4 illustrates another embodiment of the quench car shown in FIG. 3.

Another embodiment of this invention is shown in FIG. 4. In this embodiment the front wall 46 has an upper portion 70 which is rigidly attached to the end walls 40. The lower portion of front wall 46 forms a gate 71 which is joined to upper portion 70 by hinges 72. The gate 71 is freely movable away from the body of the car when the bottom wall 50 is in its inclined/dumping position. When the bottom wall 50 is in its reclined/-coke receiving position, its front edge serves to hold the gate securely against end wall 40. This alternate embodiment prevents the coke from bulging the front wall when the bottom wall moves to its dumping position and it allows the coke to be dumped more quickly and easily from the car. The open portion of gate 71 is shown in phantom lines. The gate 71 may also be connected through a linkage 74 to bottom wall 50 as shown in FIG. 4 for positive movement with the bottom wall 50. The size of the opening for dumping may be increased or decreased by changing the size of gate 71 with respect to the upper portion 70 or by changing the overall slope of front wall 46.

Further modification of the above embodiments of this invention may be made within the scope of the following claims.

We claim:

1. In a coke quench car having a container for receiving coke and a horizontal frame disposed beneath said container for support thereof, said container including a bottom wall, a pair of generally upstanding end walls, a front wall extending between corresponding upstanding edges of said end walls, and a back wall extending between corresponding edges of said end walls opposite said front wall, the improvement in said quench car which comprises:

said bottom wall being pivotally mounted on a substantially inclined position sloping from an upper end engaging the front wall to form a closure therewith, to a lower end engaging the backwall, and movable to an inclined position sloping downward in the opposite direction sufficiently to dump coke through the opening formed between said front wall and said bottom wall;

said back wall being pivotally joined along one edge thereof to said bottom wall for articulating movement therewith between said end walls;

a back plate extending between corresponding upstanding edges of said end walls adjacent the back wall, the upper edge of said back wall being in constant slidable engagement with the back plate and extending to about mid-height of the end walls in the lowered coke receiving position, and to about the full height thereof in the raised coke dumping position; and fluid motor means on each side of said end walls connected between said frame and said back walls for moving said bottom wall and said back wall along said back plate in articulated fashion between coke receiving and coke dumping positions.

2. The improved quench car of claim 1 wherein said front wall further comprises an upper portion rigidly attached at each end to said end walls and a lower portion pivotally attached along its upper edge to the lower edge of said upper portion, said lower portion forming a pivotal gate connected to said bottom wall by link means which opens said gate as the bottom wall is tilted to a coke dumping position, and closes as the bottom wall is tilted back to a reclined coke receiving position, said pivotal gate being secured in closed position by the upper edge of said reclined bottom wall so that coke will be retained in the car.

* * * * *